US011110717B2

(12) United States Patent
Hagiwara et al.

(10) Patent No.: US 11,110,717 B2
(45) Date of Patent: Sep. 7, 2021

(54) CHANNEL MEMBER, HEAD UNIT, AND HEAD UNIT GROUP

(71) Applicant: SEIKO EPSON CORPORATION, Tokyo (JP)

(72) Inventors: Hiroyuki Hagiwara, Matsumoto (JP); Katsuhiro Okubo, Azumino (JP); Kentaro Murakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 16/584,601

(22) Filed: Sep. 26, 2019

(65) Prior Publication Data

US 2020/0101754 A1 Apr. 2, 2020

(30) Foreign Application Priority Data

Sep. 27, 2018 (JP) ..... JP2018-182029

(51) Int. Cl.
*B41J 2/175* (2006.01)

(52) U.S. Cl.
CPC ..... *B41J 2/17596* (2013.01)

(58) Field of Classification Search
CPC ..... B41J 2/17596
See application file for complete search history.

(56) References Cited

U.S. PATENT DOCUMENTS

| | | | | |
|---|---|---|---|---|
| 10,183,495 | B2 | 1/2019 | Kudo et al. | |
| 10,336,080 | B2 | 7/2019 | Kudo et al. | |
| 10,457,058 | B2 | 10/2019 | Akahane | |
| 10,696,058 | B2 | 6/2020 | Kudo et al. | |
| 2002/0039536 | A1* | 4/2002 | Kurata | B41J 2/17596 417/399 |
| 2006/0152563 | A1 | 7/2006 | Kumagai et al. | |
| 2008/0158284 | A1* | 7/2008 | Nakamura | B41J 2/17513 347/20 |
| 2009/0058917 | A1* | 3/2009 | Takata | B41J 2/175 347/18 |
| 2017/0246879 | A1 | 8/2017 | Kudo et al. | |
| 2017/0341408 | A1 | 11/2017 | Akahane | |
| 2018/0111378 | A1 | 4/2018 | Kudo et al. | |
| 2019/0009569 | A1 | 1/2019 | Kudo et al. | |

FOREIGN PATENT DOCUMENTS

| | | |
|---|---|---|
| CN | 107433781 | 12/2017 |
| CN | 107984906 | 5/2018 |
| JP | 2005-095861 | 4/2005 |

* cited by examiner

*Primary Examiner* — Justin Seo
(74) *Attorney, Agent, or Firm* — Workman Nydegger

(57) ABSTRACT

A channel member includes a liquid emission port coupled to a liquid introduction section to emit liquid to the liquid introduction section, and a liquid feeding port that receives liquid from outside to feed the liquid to the liquid emission port. The liquid emission port and the liquid feeding port have the same opening direction.

14 Claims, 10 Drawing Sheets

CHANNEL MEMBER, HEAD UNIT, AND HEAD UNIT GROUP

The present application is based on, and claims priority from JP Application Serial Number 2018-182029, filed Sep. 27, 2018, the disclosure of which is hereby incorporated by reference herein in its entirety.

BACKGROUND

1. Technical Field

The present disclosure relates to a technique of feeding liquid to a liquid injection head.

2. Related Art

A valve unit is known in which an ink fed from ink cartridge is fed to a recording head (JP-A-2005-95861). Such valve unit includes an ink feeding section coupled to an ink feeding tube, and an ink emission port coupled to a recording head to emit ink toward the recording head. The ink feeding section and the ink emission port are formed on a channel forming member of the valve unit. The ink feeding section is formed on one side face of the channel forming member, and the ink emission port is formed on the bottom face of the channel forming member, which intersects with the one side face at right angles.

According to the above-mentioned technology, in the case where an ink introduction section of the recording head coupled to the ink emission port is oriented in the gravity direction, when the ink emission port is coupled to the ink introduction section, the ink feeding section is horizontally opened. For this reason, it is difficult to ensure a working space for coupling the ink feeding tube to the ink feeding section, possibly lowering the efficiency of the coupling operation. Such problem is associated with the valve unit for feeding ink to the recording head, as well as a channel member for feeding liquid to a liquid injection head.

SUMMARY

According to an aspect of the present disclosure, a channel member that feeds liquid to a liquid injection head having a liquid introduction section oriented in a +Z direction that is the gravity direction is provided. The channel member includes a liquid emission port coupled to the liquid introduction section to emit the liquid to the liquid introduction section, and a liquid feeding port that receives liquid from outside to feed the liquid to the liquid emission port. The liquid emission port and the liquid feeding port have the same opening direction.

DESCRIPTION OF EXEMPLARY EMBODIMENTS

A. Embodiment

Figure 1:
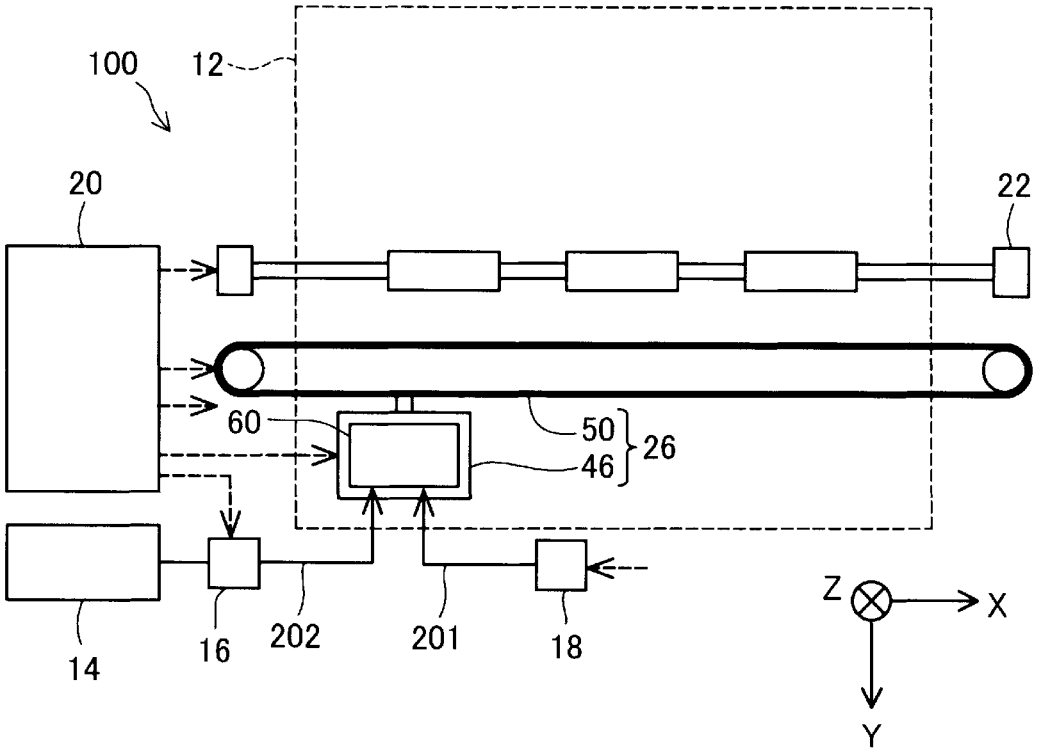
FIG. 1 is a view for describing a liquid ejecting device in accordance with an embodiment.

FIG. 1 is a view for describing a liquid ejecting device 100 in accordance with an embodiment of the present disclosure. In FIG. 1, the Z direction is the direction along the gravity direction, a +Z direction is the gravity direction, and a −Z direction is the antigravity direction that is opposite to the +Z direction. The direction orthogonal to the +Z direction is defined as a Y direction, and the direction orthogonal to the +Z direction and the Y direction is defined as an X direction. The Y direction is the direction in which below-mentioned nozzles are arranged, and a medium 12 is transported. The X direction is the direction in which a carriage 46 moves. The X direction, the Y direction, and the Z direction are illustrated in other figures as needed.

The liquid ejecting device 100 is an ink jet-type printing device that injects liquid ink to the medium 12. The medium 12 may be any printing target such as printing paper, resin film, and fabric. Liquid containers 14 for storing liquid are fixed to the liquid ejecting device 100. Examples of the liquid container 14 include a detachable cartridge of the liquid ejecting device 100, a liquid storage bag made of a flexible film, and a liquid tank refilled with liquid as needed. The plurality of liquid containers 14 may be provided to store different types of liquid, for example, different colors of liquid.

The liquid ejecting device 100 includes a control unit 20, a transport mechanism 22, head units 60, a moving mechanism 26, a liquid pumping section 16, a pressure adjustment section 18, and the liquid containers 14. The control unit 20 includes a control device such as a CPU (Central Processing Unit) and an FPGA (Field Programmable Gate Array) and a storage device such as a semiconductor memory. The control unit 20 causes the control device to execute a program stored in the storage device, thereby controlling each element of the liquid ejecting device 100. In response to a control signal from the control unit 20, the transport mechanism 22 transports the medium 12 in the +Y direction.

The liquid containers 14 store liquid to be fed to the respective head units 60. The plurality liquid containers 14 are provided for the types of stored liquid. For example, the four liquid containers 14 independently store magenta ink, yellow ink, cyan ink, and black ink.

The moving mechanism 26 reciprocates the head unit 60 in the X direction according to the control signal from the control signal from the control unit 20. The moving mechanism 26 includes the carriage 46 and a transport belt 50. The carriage 46 is a concave structure for fixing the head units 60, and is fixed to the transport belt 50. The transport belt 50 is an endless belt disposed in the X direction. The transport belt 50 rotates in response to the control signal from the control unit 20, thereby reciprocating the head unit 60 together with the carriage 46 in the X direction. The liquid container 14 together with the head unit 60 may be mounted on the carriage 46. The head unit 60 reciprocates in the X direction and however, may be a stationary head unit used in a so-called line printer.

In response to the control signal from the control unit 20, the liquid pumping section 16 pumps liquid from the liquid container 14 to the head unit 60 via a liquid tube 202. The liquid pumping section 16 may be a tube pump or an electric pump.

In response to the control signal from the control unit 20, the pressure adjustment section 18 pumps air from the outside to the head unit 60 via an air tube 201. The pressure adjustment section 18 may use an electric pump, for example. A channel communicating with liquid in the head unit 60 is provided with a valve opened under pressure. The valve is opened with air pressed by the pressure adjustment section 18. The air tube 201 and the pressure adjustment section 18 may be omitted.

The plurality of head units 60 are provided for the types of the liquid containers 14. The head unit 60 has a plurality of nozzles on its bottom wall on the +Z direction side. The head unit 60 communicates with the liquid container 14 via the liquid tube 202. In response to the control signal from the control unit 20, the head unit 60 injects liquid fed from the liquid container 14 to the medium 12 through the nozzle. While the transport mechanism 22 is transporting the medium 12 and the moving mechanism 26 is moving the head unit 60, the head unit 60 injects the liquid to the medium 12. Thereby, a desired image is formed on the medium 12.

Figure 2:
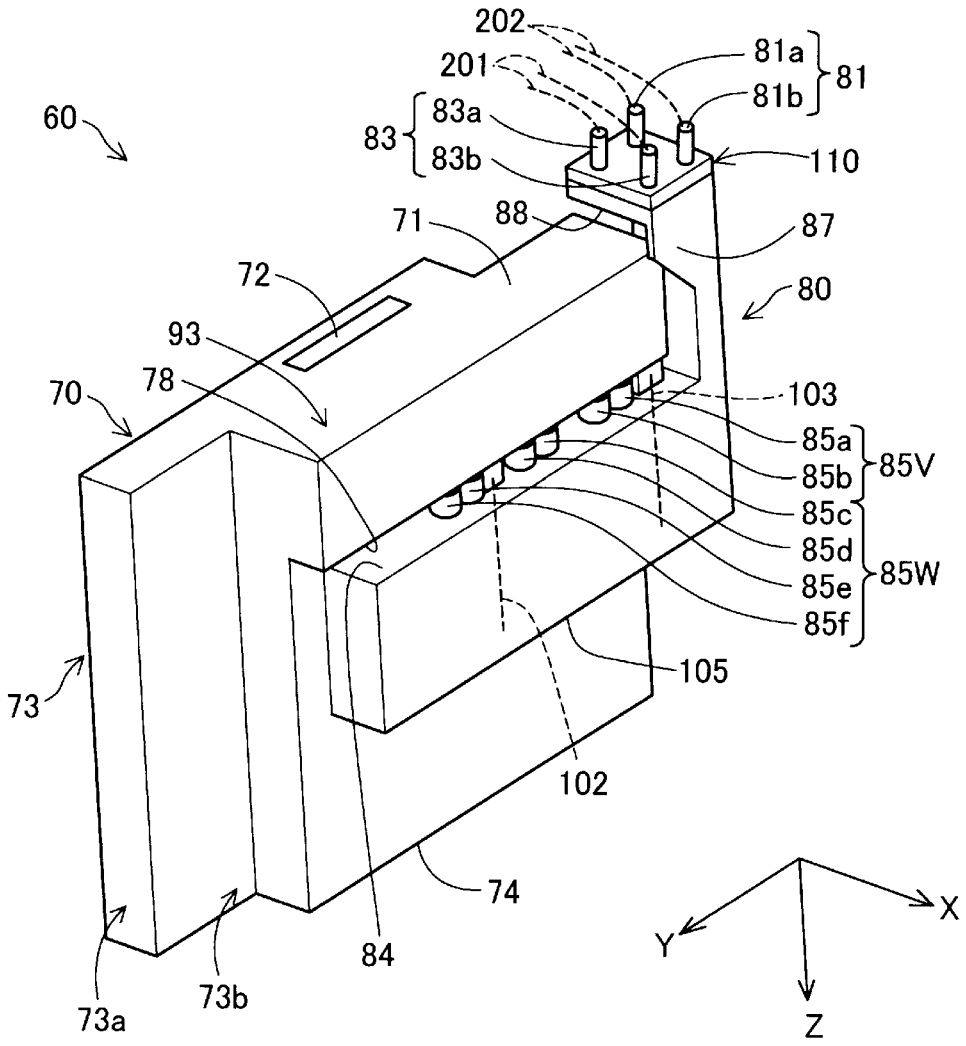
FIG. 2 is a perspective view of a head unit.
Figure 3:
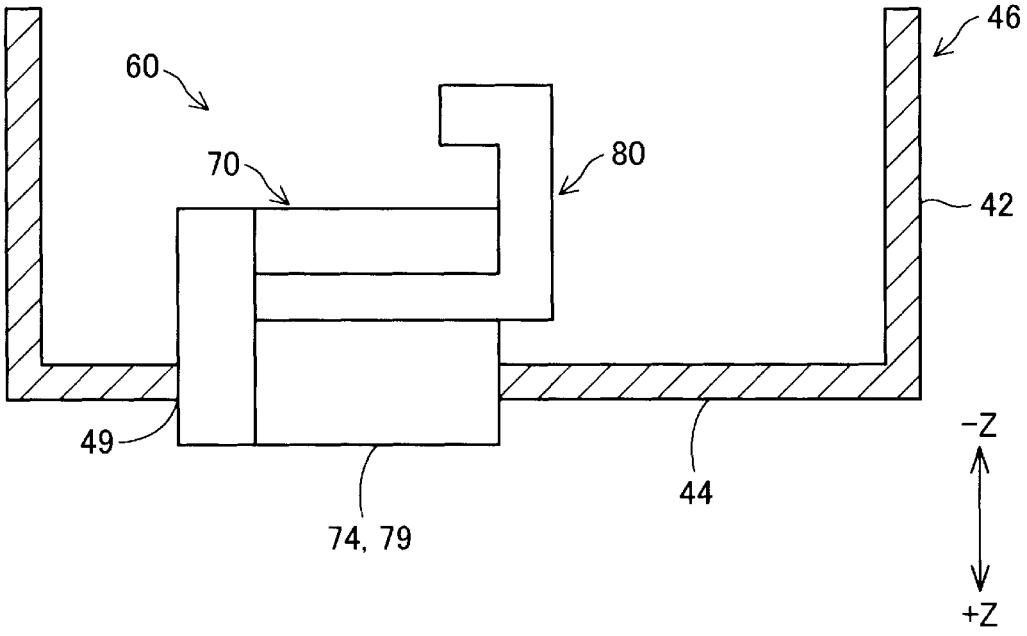
FIG. 3 is a view for describing the head unit fixed to a carriage.

FIG. 2 is a perspective view of the head unit 60. FIG. 3 is a view for describing the head unit 60 fixed to the carriage 46. As illustrated in FIG. 2, the head unit 60 includes a liquid injection head 70 and a channel member 80. The channel member 80 is detachable from the liquid injection head 70. The liquid or air fed to the channel member 80 passes the channel in the channel member 80 and then, is fed to the liquid injection head 70.

The channel member 80 is fixed to the liquid injection head 70 by use of screws 102, 103 inserted into the channel member 80 and nuts not illustrated in the liquid injection head 70. When the channel member 80 is detached from the liquid injection head 70, the screws 102, 103 are detached and then, the channel member 80 is moved in the +Z direction. As a result, a liquid emission port 85W and an air emission port 85V of the channel member 80 are pulled out from the liquid injection head 70 such that the channel member 80 is detached from the liquid injection head 70.

As illustrated in FIG. 3, the carriage 46 has a carriage bottom wall 44 forming the concave bottom, and a carriage side wall 42 rising from the edge of the carriage bottom wall 44. The carriage bottom wall 44 has openings 49 that allow nozzles 79 formed on the bottom wall 74 of the liquid injection head 70 to be exposed. In the state where the nozzles 79 are exposed from the respective openings 49, the head unit 60 is fixed to the carriage 46 by use of a screw or the like. When the carriage 46 and the head unit 60 are viewed from the +Z direction side, a portion of the channel member 80 and the carriage bottom wall 44 overlap each other. Thus, as compared to the case where a portion of the channel member 80 and the carriage bottom wall 44 do not overlap each other, the opening 49 may be made smaller, decreasing the possibility that the strength of the carriage 46 lowers.

Figure 4:
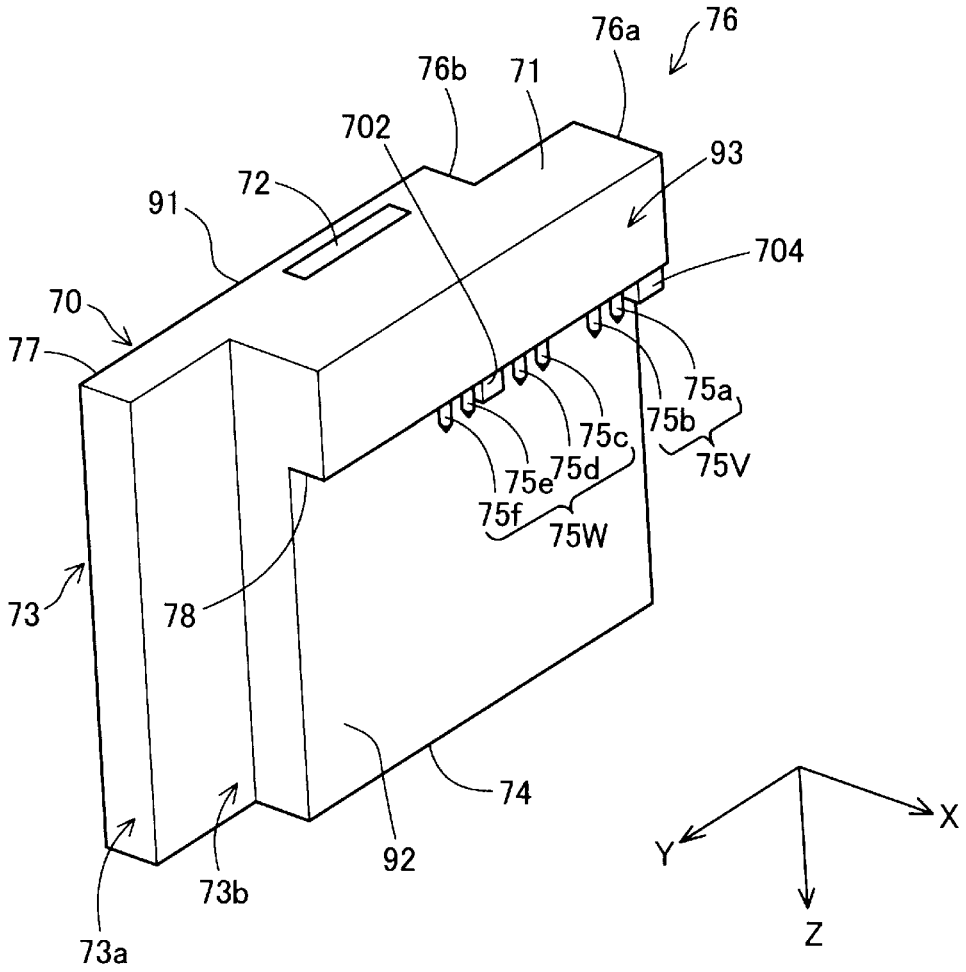
FIG. 4 is a first perspective view of a liquid injection head.
Figure 5:
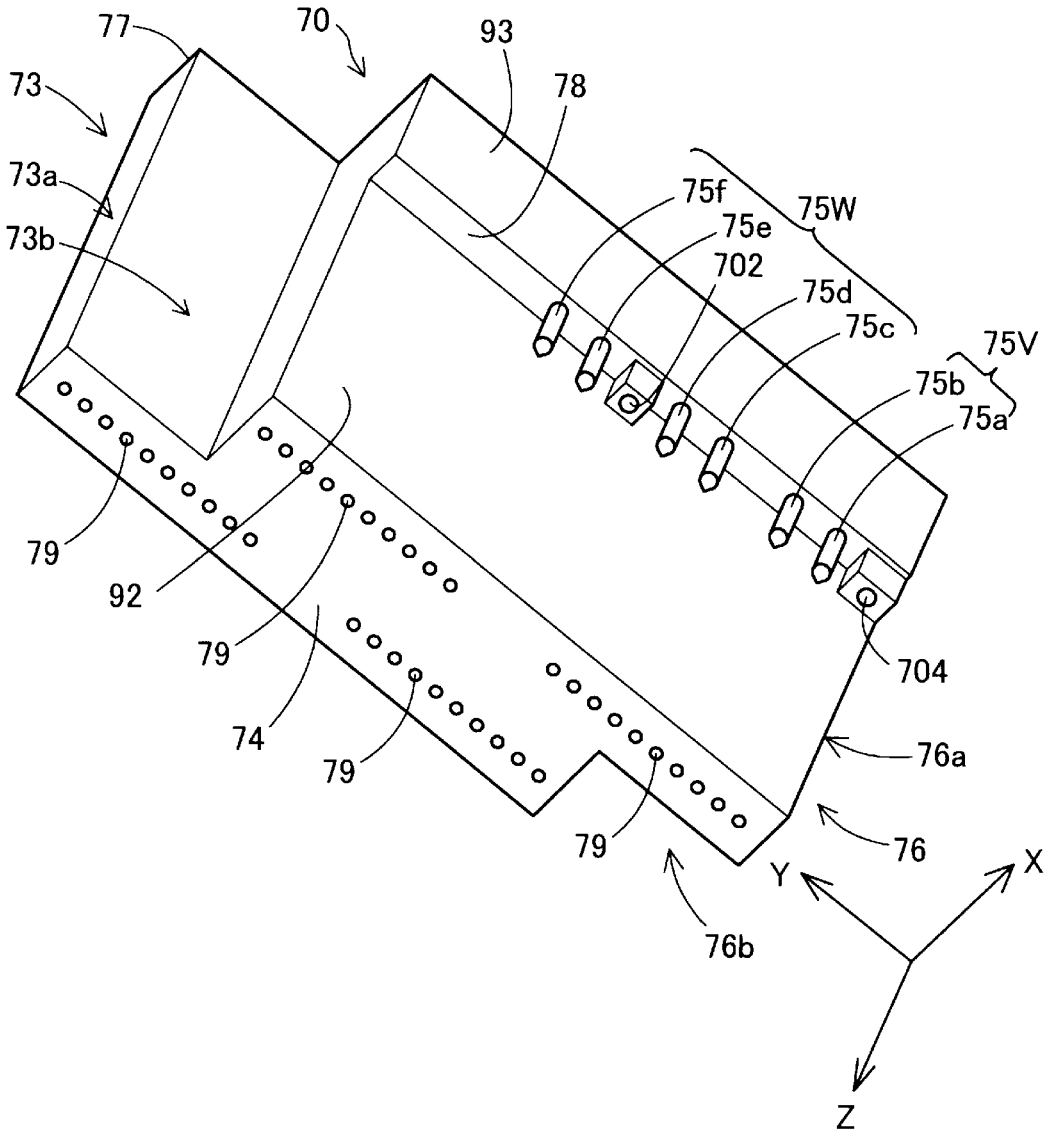
FIG. 5 is a second perspective view of the liquid injection head.

FIG. 4 is a first perspective view of the liquid injection head 70. FIG. 5 is a second perspective view of the liquid injection head 70. As illustrated in FIG. 4, the liquid injection head 70 has a head main body 77 in which the channel is formed, and a connector 72 for electrical connection to the control unit 20. The connector 72 is coupled to the control unit 20 via an electrical wiring. The connector 72 is opened to the −Z direction side. A piezoelectric element electrically coupled to the connector 72 is disposed in the head main body 77. The control unit 20 applies a driving voltage to the piezoelectric element so as to repeatedly expand and contract a portion of the liquid channel of the head main body 77. This causes the nozzle 79 to inject liquid.

The head main body 77 has a bottom wall 74, an upper wall 71, a first side wall 73, a second side wall 76, a third side wall 91, and a fourth side wall 92. The bottom wall 74 is a wall located on the +Z direction side relative to an internal space of the head main body 77. The upper wall 71 is a wall located on the −Z direction side relative to the internal space of the head main body 77. As illustrated in FIG. 5, the plurality of nozzles 79 are formed on the bottom wall 74. As illustrated in FIG. 4, the connector 72 is disposed on the upper wall 71.

The first side wall 73 to the fourth side wall 92 are walls for coupling the bottom wall 74 to the upper wall 71. The first side wall 73 is located on the +Y direction side and the second side wall 76 is located on the −Y direction side relative to the internal space of the head main body 77. The third side wall 91 is located on the −X direction side and the fourth side wall 92 is located on the +X direction side relative to the internal space of the head main body 77. The first side wall 73 has a first convex portion 73*a* protruding toward the +Y direction side and a first concave portion 73*b* dented to the −Y direction side. The first convex portion 73*a* and the first concave portion 73*b* are formed from the bottom wall 74 to the upper wall 71. The second side wall 76 has a second convex portion 76*a* protruding toward the −Y direction side and a second concave portion 76*b* dented to the +Y direction side. The second convex portion 76*a* and the second concave portion 76*b* are formed from the bottom wall 74 to the upper wall 71. The range in which the first convex portion 73*a* is located is contained in the range in which the second concave portion 76*b* is located in the X direction. The first convex portion 73*a* and the second concave portion 76*b* may be located in the same range. The range in which the second convex portion 76*a* is located in the range in which the first concave portion 73*b* is located in the X direction. The first concave portion 73*b* and the second convex portion 76*a* may be located in the same range.

The head main body 77 has a protrusion section 93 that protrudes from a side end of the upper wall 71 of the fourth side wall 92 to the +X direction side. A plurality of air introduction sections 75*a*, 75*b*, a plurality of liquid introduction sections 75*c*, 75*d*, 75*e*, and 75*f*, and a plurality of nut layout sections 702, 704 are disposed on an introduction section layout wall 78 on the +Z direction side of the protrusion section 93. The direction normal to the introduction section layout wall 78 is the +Z direction. That is, the introduction section layout wall 78 is oriented in the +Z direction. The introduction section layout wall 78 is located on the −Z direction side relative to the upper wall 71.

The two air introduction sections 75*a*, 75*b* are provided in this embodiment. When it is unnecessary to distinguish the air introduction sections 75*a*, 75*b* from each other, the air introduction sections are collectively represented as the air introduction section 75V. The two air introduction sections 75*a*, 75*b* each are a needle-shaped member extending from the introduction section layout wall 78 in the +Z direction. The two air introduction sections 75*a*, 75*b* are aligned in the Y direction. The opening direction of the air introduction section 75V is the +Z direction. That is, the air introduction section 75V is opened to the +Z direction side. The opening direction of the air introduction section 75V is the direction in which the needle-shaped air introduction section 75V extends from the introduction section layout wall 78. The air introduction section 75V is a section into which pressurized air emitted from the channel member 80 is introduced. The pressurized air introduced into the head main body 77 through the air introduction section 75V opens a valve mechanism for opening/closing the liquid channel in the head main body 77. The valve mechanism for opening/closing the liquid channel may be a diaphragm-type differential pressure regulation valve for controlling the negative pressure of the liquid channel in the head. The pressurized air may be used to open/close the differential pressure regulation valve. The air introduction section 75V is not limited to the needle-shaped member, and may be any other member opened to the +Z direction side. For example, the air introduction section 75V may be a cylindrical member, or may be shaped to insert a needle-shaped member or a cylindrical member thereinto. When the liquid ejecting device 100 does not include the pressure adjustment section 18, the air introduction section 75V may be omitted.

The four plurality of liquid introduction sections 75*c*, 75*d*, 75*e*, and 75*f* are provided in this embodiment. When it is unnecessary to distinguish the plurality of liquid introduction sections 75*c*, 75*d*, 75*e*, and 75*f* from one another, the liquid introduction sections are collectively represented as the liquid introduction section 75W. The four liquid introduction sections 75*c*, 75*d*, 75*e*, and 75*f* are aligned in the Y direction. The four liquid introduction sections 75*c*, 75*d*, 75*e*, and 75*f* each are a needle-shaped member that extends from the introduction section layout wall 78 in the +Z direction. The opening direction of the liquid introduction section 75W is the +Z direction. That is, the liquid introduction section 75W is opened to the +Z direction side. The opening direction of the liquid introduction section 75W is the direction in which the needle-shaped liquid introduction section 75W extends from the introduction section layout wall 78. The liquid introduction section 75W is a section into which liquid emitted from the channel member 80 is introduced. The liquid introduced into the head main body 77 through the liquid introduction section 75W reaches the nozzles 79 via the internal channel in the head main body 77. The liquid introduction section 75W is not limited to the needle-shaped member and may be any other member opened to the +Z direction side. For example, the liquid introduction section 75W may be a cylindrical member, may be a filter or nonwoven fabric in the opening, or may insert a needle-shaped member or cylindrical member thereinto.

The two nut layout sections 702, 704 are provided in this embodiment. The nuts are disposed in the respective nut layout sections 702, 704. The nut layout section 702 is located between the two liquid introduction sections 75*d*, 75*e* that are adjacent to each other in the Y direction.

Figure 6:
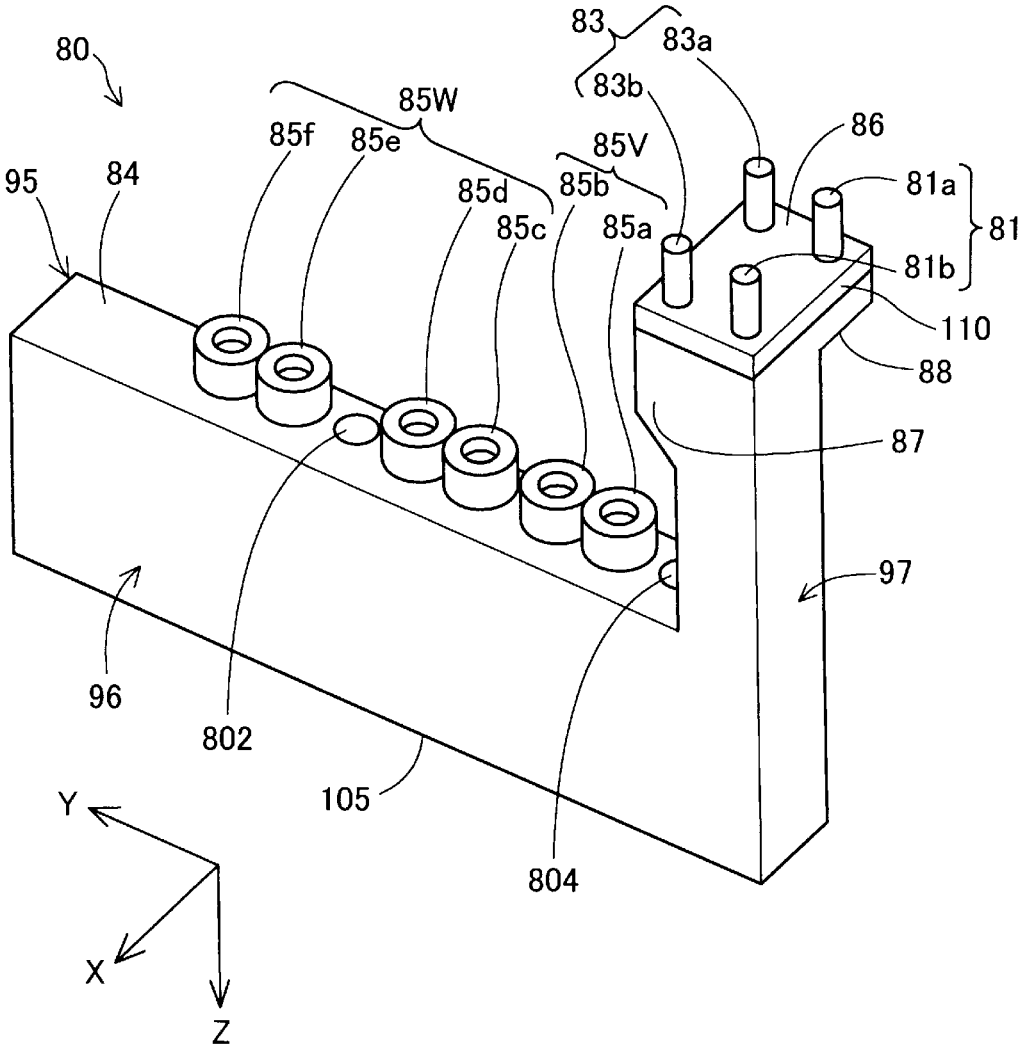
FIG. 6 is a first perspective view of a channel member.
Figure 7:
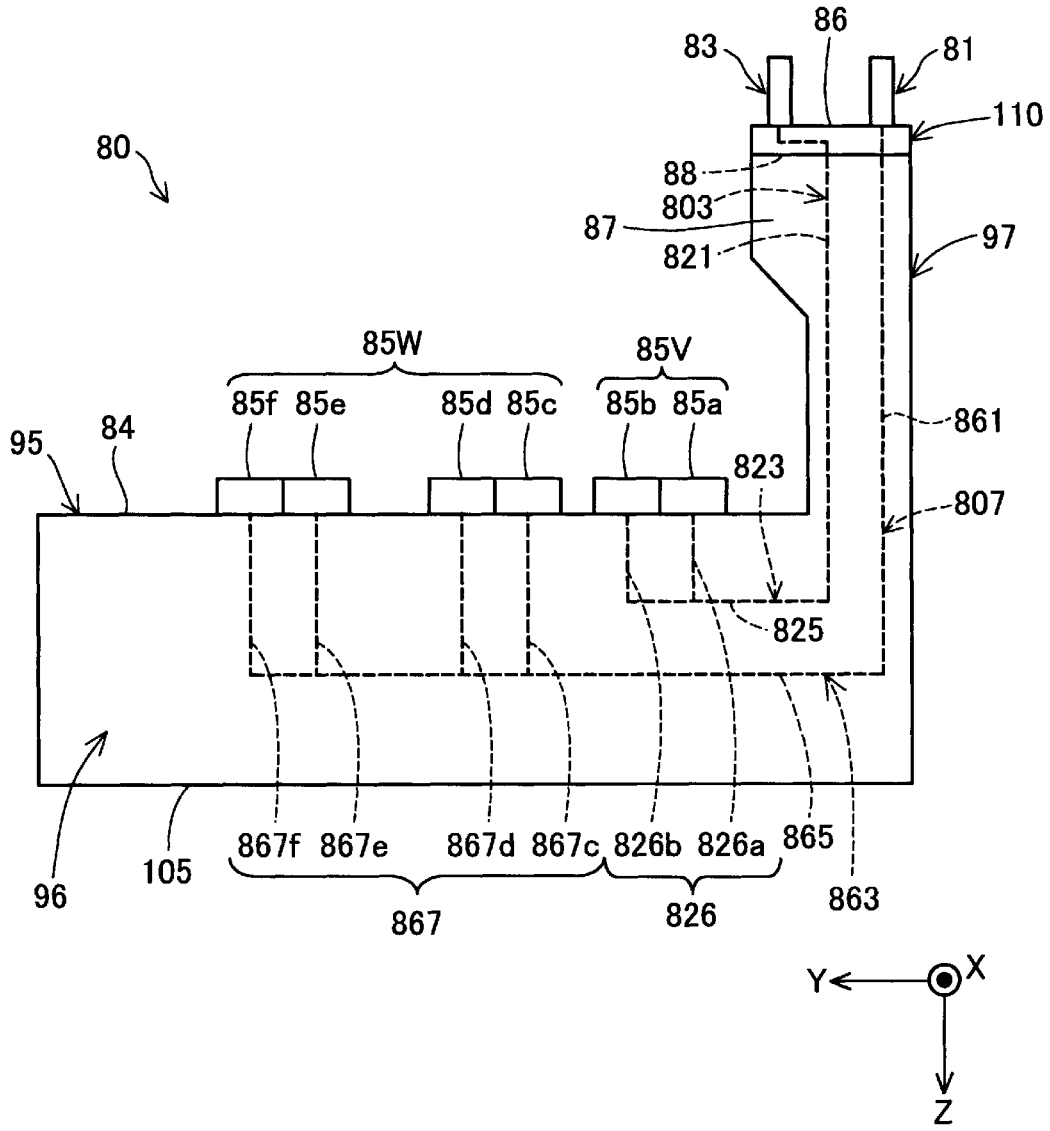
FIG. 7 is a side view of the channel member.
Figure 8:
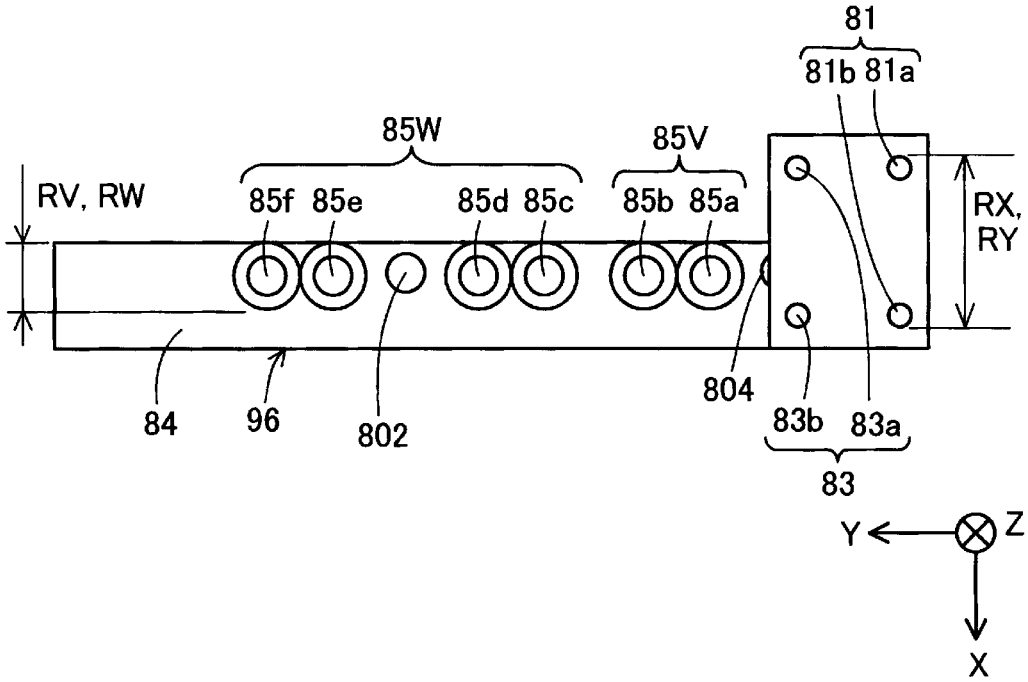
FIG. 8 is a top view of the channel member.
Figure 9:
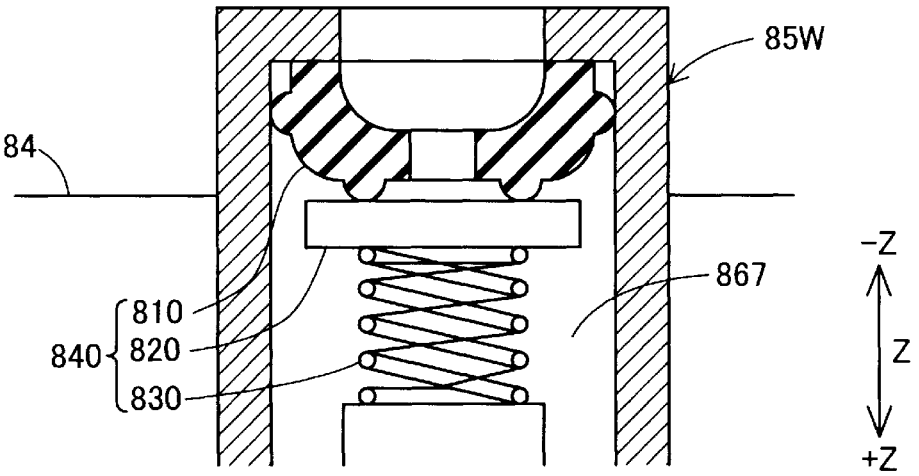
FIG. 9 is a view for describing a valve having a liquid emission port as one end.

FIG. 6 is a first perspective view of the channel member 80. FIG. 7 is a side view of the channel member 80. FIG. 8 is a top view of the channel member 80. FIG. 9 is a view for describing a valve 801 in a channel 867 having the liquid emission port 85W as one end.

As illustrated in FIG. 6, the channel member 80 has a channel main body 95 forming a channel therein. The channel main body 95 is formed of an inflexible member. The channel main body 95 is made of a synthetic resin such as polypropylene and polyethylene. The channel main body 95 constitutes a frame of the channel main body 95, and is formed of a below-mentioned frame member on which the air emission port 85V and the liquid emission port 85W are formed, and a plurality of members welded to the frame member. The plurality of members include a first cover member that forms a side wall of the frame member on the +X direction side, a second cover member that forms a side wall on the −X direction side of a feeding-side channel section 97 extending in the Z direction in the frame member, and a member that forms an end 110 on the +Z direction side of the feeding-side channel section 97. The channel main body 95 may be configured of members other than the above-mentioned members, or may be configured of a single member.

The channel member 80 further has a plurality of air emission ports 85*a*, 85*b*, a plurality of liquid emission ports 85*c*, 85*d*, 85*e*, and 85*f*, a plurality of air feeding ports 83*a*, 83*b*, and a plurality of liquid feeding ports 81*a*, 81*b*.

The two air emission ports 85*a*, 85*b* are provided in this embodiment. When it is unnecessary to distinguish the plurality of air emission ports from each other, the air emission ports are collectively represented as the air emission port 85V. The two air emission ports 85*a*, 85*b* are aligned in the Y direction. The two air emission ports 85*a*, 85*b* each are a cylindrical member. The air emission port 85V is coupled to the air introduction section 75V, and air pressurized by the pressure adjustment section 18 is fed to the air introduction section 75V. The opening direction of the air emission port 85V is the −Z direction. That is, the air emission port 85V is opened to the −Z direction side. In this embodiment, the opening direction of the air emission port 85V is the direction in which the air emission port 85V extends from an emission port layout wall 84. The air emission port 85V is not limited to the cylindrical member and may be any other member whose opening direction is the −Z direction. For example, the air emission port 85V may be a needle-shaped member. When the liquid ejecting device 100 does not include the pressure adjustment section 18, the air emission port 85V may be omitted.

The four liquid emission ports 85*c*, 85*d*, 85*e*, and 85*f* are provided in this embodiment. When it is unnecessary to distinguish the liquid emission ports 85*c*, 85*d*, 85*e*, and 85*f* from one another, the liquid emission ports are collectively represented as the liquid emission port 85W. The four liquid emission ports 85*c*, 85*d*, 85*e*, and 85*f* are aligned in the Y direction. The four liquid emission ports 85*c*, 85*d*, 85*e*, and 85*f* each are a cylindrical member. The liquid emission port 85W is coupled to the liquid introduction section 75W, and emits liquid to the liquid introduction section 75W. The opening direction of the liquid emission port 85W is the −Z direction. That is, the liquid emission port 85W is opened to the −Z direction side. The opening direction of the liquid emission port 85W is the direction in which the liquid emission port 85W extends from the emission port layout wall 84. The liquid emission port 85W is not limited to the cylindrical member and may be any other member whose opening direction is the −Z direction. For example, the liquid emission port 85W may be a needle-shaped member.

The two air feeding ports 83*a*, 83*b* are provided in this embodiment. When it is unnecessary to distinguish the air feeding ports 83*a*, 83*b* from each other, the air feeding ports are collectively represented as the air feeding port 83. The two air feeding ports 83*a*, 83*b* are aligned in the X direction. The two air feeding ports 83*a*, 83*b* each are a cylindrical member. The air feeding port 83 is coupled to the air tube 201 to receive pressurized air, thereby feeding the pressurized air to the air emission port 85V. The opening direction of the air feeding port 83 is the −Z direction. That is, the air feeding port 83 is opened to the −Z direction side. The opening direction of the air feeding port 83 is the direction in which the air feeding port 83 extends from the end 110 on the +Z direction side. The air feeding port 83 is located on the −Z direction side relative to the air emission port 85V. As illustrated in FIG. 2, in the head unit 60, the air feeding port 83 is located on the −Z direction side relative to the connector 72. In the head unit 60, the air feeding port 83 is located on the −Z direction side relative to the liquid injection head 70. As illustrated in FIG. 8, a range RX in which the air feeding ports 83*a*, 83*b* are located is larger than a range RV in which the air emission ports 85*a*, 85*b* are located in the X direction. This may ensure a large distance between the air feeding ports 83*a*, 83*b* in the X direction. Therefore, the efficiency of the operation of coupling the air tube 201 to each of the air feeding ports 83*a*, 83*b* may be suppressed from decreasing. This may also suppress the emission-side channel section 96 provided with the air emission ports 85*a*, 85*b* from becoming large in the X direction.

As illustrated in FIG. 6, the two liquid feeding ports 81*a*, 81*b* are provided in this embodiment. When it is unnecessary to distinguish the liquid feeding ports 81*a*, 81*b* from each other, the liquid feeding ports are collectively represented as the liquid feeding port 81. The two liquid feeding ports 81*a*, 81*b* are aligned in the X direction. The two liquid feeding ports 81*a*, 81*b* each are a cylindrical member. The liquid feeding port 81 is coupled to the liquid tube 202 to receive liquid, thereby feeding the liquid to the liquid emission port 85W. The opening direction of the liquid feeding port 81 is the −Z direction. That is, the liquid feeding port 81 is opened to the −Z direction side. The opening direction of the liquid feeding port 81 is the direction in which the liquid feeding port 81 extends from the end 110 on the +Z direction side. The liquid feeding port 81 is located on the −Z direction side relative to the liquid emission port 85W. As illustrated in FIG. 2, in the head unit 60, the liquid feeding port 81 is located on the −Z direction side relative to the connector 72. In the head unit 60, the liquid feeding port 81 is located on the −Z direction side relative to the liquid injection head 70. As illustrated in FIG. 8, a range RY in which the plurality of liquid feeding ports 81*a*, 81*b* are located is larger than a range RW in which the plurality of liquid emission ports 85*c*, 85*d*, 85*e*, and 85*f* are located in the X direction. This may ensure a large distance between the liquid feeding ports 81*a*, 81*b* in the X direction. Therefore, the efficiency of the operation of coupling the liquid tube 202 to each of the liquid feeding port 81*a*, 81 may be suppressed from decreasing. This may also suppress the emission-side channel section 96 provided with the liquid emission ports 85*c*, 85*d*, 85*e*, and 85*f* from becoming large in the X direction. In this embodiment, the range RX is the same as the range RY and the range RV is the same as the range RW.

As described above, both the liquid feeding port 81 and the liquid emission port 85W have the same direction that is the −Z direction. Both the air emission port 85V and the air feeding port 83 have the same direction that is the −Z direction. The "same direction" is not necessarily the exact same direction and allows a slight deviation.

As illustrated in FIG. 6, the channel main body 95 has the substantially parallelepiped-shaped emission-side channel section 96, and the feeding-side channel section 97 located on the −Y direction side relative to the emission-side channel section 96. The emission-side channel section 96 has the emission port layout wall 84 located on the +Z direction side and a channel bottom wall 105 located on the −Z direction side relative to the internal channel. The normal direction of the emission port layout wall 84 is the −Z direction. That is, the emission port layout wall 84 is the wall oriented to the −Z direction side. The liquid emission port 85W and the air emission port 85V are disposed on the emission port layout wall 84. As illustrated in FIG. 2, the emission port layout wall 84 is opposed to the introduction section layout wall 78 in the Z direction.

As illustrated in FIG. 6, the emission port layout wall 84 has two screw insertion holes 802, 804 for inserting the screws 102, 103 for fixing the channel member 80 to the liquid injection head 70. The screw insertion holes 802, 804 are formed from the channel bottom wall 105 to the emission port layout wall 84. The screws 102, 103 are inserted into the screw insertion holes 802, 804 and fastened with nuts, thereby fixing the liquid injection head 70 to the channel member 80. Thus, even when pressurized air or pressurized liquid flows in the head unit 60 or the head unit 60 is shocked, the possibility that the channel member 80 comes off the liquid injection head 70 may be lowered. When the channel member 80 is subjected to an external force from the tube or the like, it is less likely to generate a leakage of liquid or air at the contact between the liquid injection head 70 and the channel member 80. By forming the screw insertion holes 802, 804 on the emission port layout wall 84 provided with the liquid emission port 85W and the air emission port 85V, as compared to the case of forming a new wall having the screw insertion holes 802, 804, an increase in size of the channel member 80 and the liquid injection head 70 may be suppressed.

As illustrated in FIG. 8, one screw insertion hole 802 of the two screw insertion holes 802, 804 is located between the first liquid emission port 85*d* and the second liquid emission port 85*e* among the plurality of liquid emission ports 85*c*, 85*d*, 85*e*, and 85*f* in the Y direction. Thus, as compared to the case where the one screw insertion hole 802 is away from the liquid emission port 85W, for example, is formed at the end of the emission port layout wall 84 on the +Y direction side, the channel member 80 may be fixed to the liquid injection head 70 with the screws at a closer position to the liquid emission port 85W. This may lower the possibility that the liquid emission ports 85*c*, 85*d*, 85*e*, and 85*f* are detached from the liquid introduction section 75*c*, 75*d*, 75*e*, and 75*f*, respectively.

As illustrated in FIG. 7, the feeding-side channel section 97 extends further than the emission-side channel section 96 in the −Z direction. The liquid feeding port 81 and the air feeding port 83 are formed at the end 110 of the feeding-side channel section 97 on the +Z direction side. As illustrated in FIG. 2, the channel member 80 is formed near the end 110 on the +Z direction side, and has an opposing wall 88 opposed to the upper wall 71 of the liquid injection head 70. The normal direction of the opposing wall 88 is the +Z direction. That is, the opposing wall 88 is oriented to the +Z direction side.

As illustrated in FIG. 6, the feeding-side channel section 97 has a rib 87 on the −Z direction side relative to the liquid feeding port 81*a* and the air feeding port 83. As illustrated in FIG. 2, the rib 87 is located in a range of a gap between the opposing wall 88 and the upper wall 71 in the Z direction. The rib 87 protrudes from the feeding-side channel section 97 to the +Y direction side. The rib 87 is a member for preventing the user's finger from entering between the channel member 80 and the liquid injection head 70 when the user removes the channel member 80 from the liquid injection head 70. This may lower the possibility that the user's finger is pinched between the channel member 80 and the liquid injection head 70. The rib 87 may also increase the strength of the channel member 80.

As illustrated in FIG. 7, the channel member 80 has an air channel 803 and a liquid channel 807. The air channel 803 couples the air feeding port 83 to the air emission port 85V, allowing air introduced into the air feeding port 83 to pass through the air emission port 85V. The liquid channel 807 couples the liquid feeding port 81 to the liquid emission port 85W, allowing liquid introduced into the liquid feeding port 81 to pass through the liquid emission port 85W.

The air channel 803 has a first air channel 821 formed in the feeding-side channel section 97 and a second air channel 823 that is coupled to the first air channel 821 and formed in the emission-side channel section 96. The first air channel 821 is the channel in which air that is introduced through the two air feeding ports 83*a*, 83*b* and merged at the end 110 on the +Z direction side passes. The first air channel 821 is the channel extending in the Z direction. The second air channel 823 has a channel 825 extending from the first air channel 821 in the +Y direction and two channels 826*a*, 826*b* that are branched from the channel 825 and extend in the −Z direction. The two channels 826*a*, 826*b* are coupled to the air emission ports 85*a*, 85*b*, respectively. When it is unnecessary to distinguish the two channels 826*a*, 826*b* from each other, the channels are collectively represented as the channel 826. As described above, the air channel 803 is configured of the channel extending in the Y direction and the channel extending in the Z direction. The channel extending in the Y direction includes the channel 825, and the channel extending in the Z direction includes the first air channel 821 and the channel 826. In this manner, since the air channel 803 is configured of the channel 825 extending in the Y direction and the channels 821, 826 extending in the Z direction, an increase in size of the channel member 80 in the X direction may be suppressed. The phrases "extending in the Y direction" and "extending in the Z direction" conceptually include slightly meandering or bending but substantially extending in the Y direction or the Z direction. The channel 825 slightly meanders to bypass the screw insertion holes 804.

The liquid channel 807 has a first liquid channel 861 formed in the feeding-side channel section 97 and the second liquid channel 863 that is coupled to the first liquid channel 861 and formed in the emission-side channel section 96. The first liquid channel 861 is the channel in which liquid that is introduced through the two liquid feeding ports 81*a*, 81*b* and merged at the end 110 on the +Z direction side. The first liquid channel 861 is the channel extending in the Z direction. The second liquid channel 863 has a channel 865 extending from the first liquid channel 861 in the +X direction and four liquid emission channels 867*c*, 867*d*, 867*e*, and 867*f* that are branched into four from the channel 865 and extend in the −Z direction. The four liquid emission channels 867*c*, 867*d*, 867*e*, and 867*f* are coupled to the liquid emission ports 85*c*, 85*d*, 85*e*, and 85*f*, respectively. When it is unnecessary to distinguish the four liquid emission channels 867*c*, 867*d*, 867*e*, 867*f* from one another, the liquid emission channels are collectively represented as the liquid emission channel 867. As described above, the liquid channel 807 is configured of the Y-direction channel extending in the Y direction and the Z-direction channel extending in the Z direction. The Y-direction channel is the channel 865, and the Z-direction channel is the first liquid channel 861 and the liquid emission channel 867. In this manner, since the liquid channel 807 is configured of the Y-direction channel 865 and the Z-direction channels 861, 867, an increase in size of the channel member 80 in the X direction may be suppressed. The phrases "extending in the Y direction" and "extending in the Z direction" conceptually include slightly meandering or bending but substantially extending in the Y direction or the Z direction. The channel 865 slightly meanders to bypass the screw insertion holes 802, 804.

As illustrated in FIG. 9, a valve mechanism 840 for opening/closing the liquid emission channel 867 is disposed in the liquid emission channel 867. The liquid emission channel 867 is the channel that has the liquid emission port 85W at one end and extends in the +Z direction. The valve mechanism 840 includes a seal section 810, a valve body 820, and a biasing member 830 from the −Z direction side toward the +Z direction side. The seal section 810 is a substantially annular member. The seal section 810 is made of an elastic body such as rubber and elastomer. When the liquid introduction section 75W of the liquid injection head 70 is inserted into the liquid emission port 85W, the seal section 810 is in contact with the outer circumferential face of the liquid introduction section 75W in an airtight manner. This may suppress liquid from leaking through the gap between the liquid introduction section 75W and the seal section 810. The valve body 820 is a substantially cylindrical member. In the pre-coupled state in which the liquid introduction section 75W is not inserted into the liquid emission port 85W, the valve body 820 is biased toward the seal section 810 by the biasing member 830 to close a valve hole formed on the seal section 810. That is, in the pre-coupled state, the valve mechanism 840 is opened. The biasing member 830 is a compression coil spring. In the coupled state in which the liquid introduction section 75W is inserted into the liquid emission port 85W, the valve body 820 is pressed by the liquid introduction section 75W to be away from the seal section 810. Thereby, the valve mechanism 840 is opened. As described above, the valve mechanism 840 is opened when coupled to the liquid introduction section 75W, and is closed when the liquid introduction section 75W is removed from the liquid emission port 85W. Thus, in the pre-coupled state, liquid may be suppressed from leaking to the outside through the liquid emission port 85W.

The valve mechanism 840 is not provided in the channel 826 having the air emission port 85V at one end. Only the seal section 810 that is in contact with the outer circumferential face of the air introduction section 75V in an airtight manner is disposed in the air emission port 85V. This may decrease manufacturing costs of the head unit 60. Since the channel 826 having the air emission port 85V at one end may be shortened in the Z direction, the degree of freedom in arrangement of the second liquid channel 863 may be improved.

Figure 10:
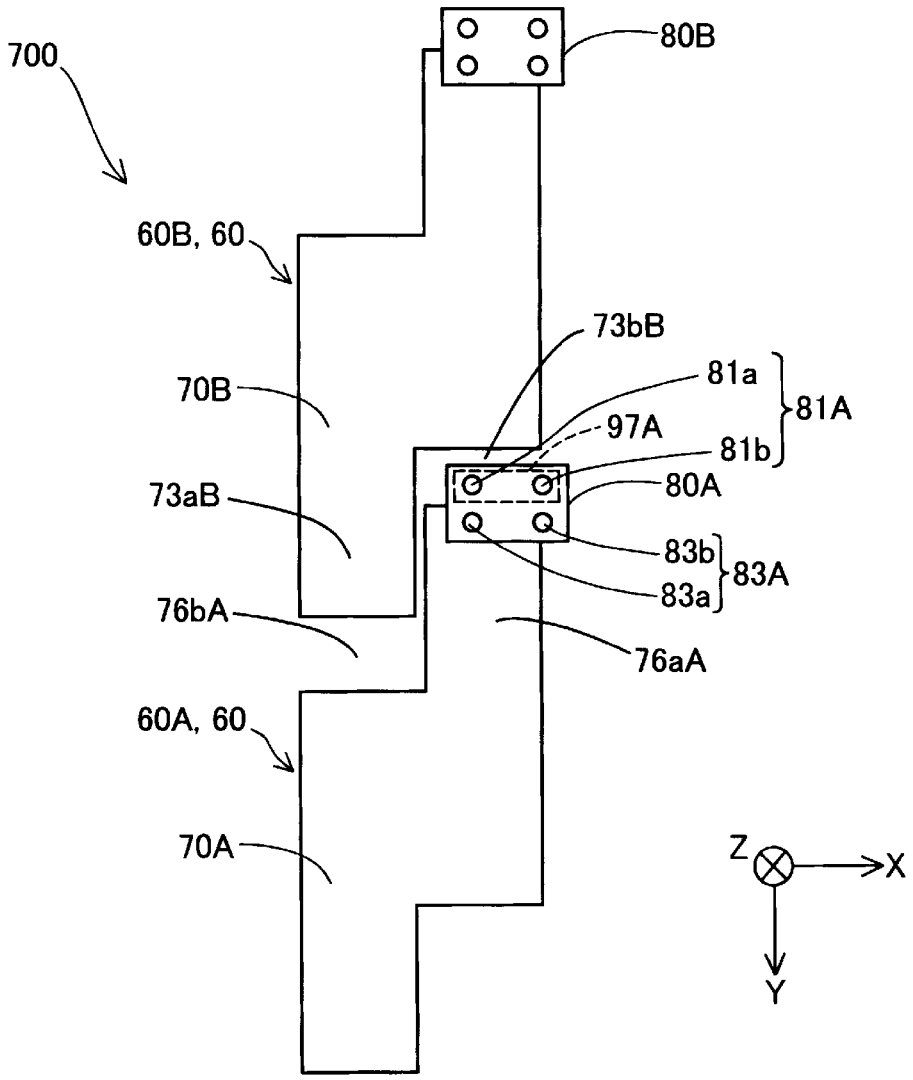
FIG. 10 is a first view for describing a head unit group.
Figure 11:
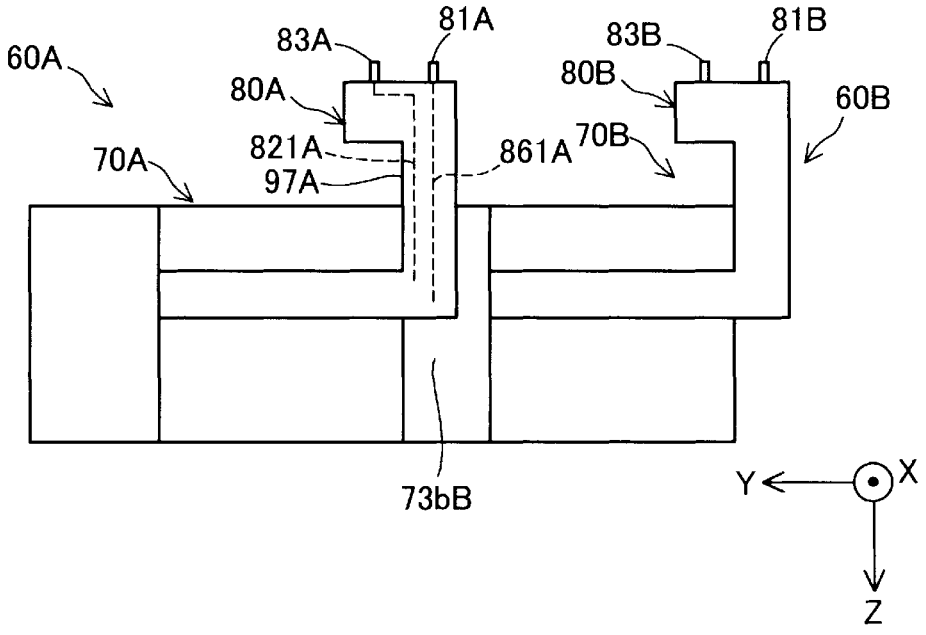
FIG. 11 is a second view for describing the head unit group.

FIG. 10 is a first view for describing a head unit group 700. FIG. 11 is a second view for describing the head unit group 700. The head unit group 700 has a plurality of head units 60 aligned in the Y direction. The plurality of head units 60 are fixed to the carriage 46. In this embodiment, in the head unit group 700, the two head units 60 are adjacent to each other in the Y direction. Out of the two head unit 60, one is referred to as a first head unit 60A and the other is referred to as a second head unit 60B. A sign A is assigned to the end of the reference sign of each element of the first head unit 60A, and a sign B is assigned to the end of the reference sign of each element of the second head unit 60B.

A second convex portion 76*a*A of the first head unit 60A is located in a first concave portion 73*b*B of the second head unit 60B adjacent to the first head unit 60A in the Y direction. The first convex portion 73*a*B of the second head unit 60B is located in the second concave portion 76*b*A of the first head unit 60A. That is, the first liquid injection head 70A and the second liquid injection head 70B are partially located in the same range in the Y direction. This may suppress the pitch of the nozzles 79 of the head unit group 700 from becoming large.

As illustrated in FIGS. 10 and 11, since the feeding-side channel section 97A of the first head unit 60A is located in the concave portion 73*b*B of the second liquid injection head 70B of the second head unit 60B, the feeding-side channel section 97A of the first head unit 60A is sandwiched between the first liquid injection head 70A and the second liquid injection head 70B in the Y direction. That is, the first air channel 821A and the first liquid channel 861A of the first channel member 80A that extend along the +Z direction are located in the concave portion 73*b*B of the second liquid injection head 70B so as to be sandwiched between the first liquid injection head 70A and the second liquid injection head 70B in the Y direction. Due to the above-mentioned positional relation, the concave portion 73*b*B of the second liquid injection head 70B may be effectively used to dispose the first air channel 821A and the first liquid channel 861. Therefore, as compared to the case where the feeding-side channel section 97A provided with the first air channel 821A and the first liquid channel 861A is displaced from the first liquid injection head 70A and the second liquid injection head 70B in the X direction, an increase in size of the head unit group 700 in the X direction may be suppressed.

As illustrated in FIG. 10, when viewing the head unit group 700 from the −Z direction side, the channel member 80A of the first head unit 60A and the second head unit 60B do not overlap each other. Thus, when the first head unit 60A is moved in the +Z direction, the first head unit 60A may be suppressed from interfering with the second head unit 60B. Accordingly, for example, when the first head unit 60A is removed from the carriage 46 or is fixed to the carriage 46, the first head unit 60A may be suppressed from interfering with the second head unit 60B. As a result, the head unit may be detached one by one to improve the efficiency of operations such as replacement and repair of the first head unit 60A. The channel member 80A of the first head unit 60A may be removed from or fixed to the first liquid injection head 70A without interfering with the second head unit 60B.

Preferably, the air tube 201 coupled to the air feeding port 83 and the liquid tube 202 coupled to the liquid feeding port 81 are pulled from the air feeding port 83 and the liquid feeding port 81 in the −Z direction, respectively, with a slack. With this configuration, the head unit 60 coupled to the air tube 201 and the liquid tube 202 may be easily removed from the carriage 46. The plurality of air tube 201 and the plurality of liquid tube 202 may be bundled. This may further improve the operability of detachment of the head unit 60 from the carriage 46.

In the above-mentioned embodiment, as illustrated in FIG. 6, the opening direction of the liquid feeding port 81 and the liquid emission port 85W is the −Z direction. Accordingly, liquid may be received from the −Z direction side via the liquid feeding port 81, and be emitted to the liquid introduction section 75W through the liquid emission port 85W. The opening direction of the air feeding port 83 and the air emission port 85V is the −Z direction. Accordingly, air may be received from the −Z direction side via the air feeding port 83, and be emitted to the air introduction section 75V through the air emission port 85V. Therefore, it is possible to suppress the efficiency of the operation of coupling the liquid tube 202 to the liquid feeding port 81 and the operation of coupling the air tube 201 to the air feeding port 83 from lowering.

In the above-mentioned embodiment, as illustrated in FIG. 6, since the liquid feeding port 81 is located on the −Z direction side relative to the liquid emission port 85W, a space on the −Z direction side of the liquid feeding port 81 is easily ensured. Thus, when the liquid tube 202 is coupled to the liquid feeding port 81, the efficiency of the coupling operation may be further suppressed from lowering. Especially when a lot of head units 60 are provided, the liquid tubes 202 may be easily routed the head units 60 in parallel. The plurality of liquid tubes 202 routed in parallel may easily take the substantially same length, in turn, the substantially same channel resistance to the head units 60. This may suppress a variation in the flow rate of the head units 60 at cleaning. By locating the air feeding port 83 on the −Z direction side relative to the air emission port 85V, like the liquid feeding port 81, the efficiency of the operation of coupling the air tube 201 to the air feeding port 83 may be further suppressed from lowering. Especially, as illustrated in FIG. 2, in the head unit 60, the liquid feeding port 81 and the air feeding port 83 are located on the −Z direction side relative to the liquid injection head 70. This may easily ensure a space on the −Z direction side of the liquid feeding port 81 and the air feeding port 83. Thus, when the liquid tube 202 and the air tube 201 are coupled to the liquid feeding port 81 and the air feeding port 83, respectively, the possibility that the liquid injection head 70 becomes an obstacle may be decreased, suppressing the efficiency of the coupling operation from lowering. Further, spaces for the liquid tube 202 and the air tube 201 are easily ensured.

In the above-mentioned embodiment, as illustrated in FIG. 4, in the liquid injection head 70, the liquid introduction section 75W is oriented in the +Z direction that is the gravity direction, and is located on the +Z direction side relative to the connector 72. Thus, at attachment/detachment of the liquid injection head 70 to/from the channel member 80, even when liquid leaks from the liquid introduction section 75W, the leaked liquid may be suppressed from adhering to the connector 72 to suitably maintain electrical connection between the connector 72 and the control unit 20.

In the above-mentioned embodiment, as illustrated in FIG. 2, the emission port layout wall 84 opposed to the introduction section layout wall 78 and the opposing wall 88 opposed to the upper wall 71 are provided. That is, the emission port layout wall 84 and the opposing wall 88 are disposed so as to sandwich a portion of the liquid injection head 70 therebetween in the Z direction. Thus, to attach/detach the channel member 80 to/from the liquid injection head 70, when the channel member 80 is moved in the Z direction, the moving range of the channel member 80 may be limited. This may decrease the possibility that the channel member 80 hits against any member other than the head unit 60, for example, the carriage 46. To detach the channel member 80 from the liquid injection head 70, the channel member 80 is moved in the +Z direction to couple the liquid emission port 85W to the liquid introduction section 75W and release coupling between the air emission port 85V and the air introduction section 75V and then, the channel member 80 is moved in the +X direction.

In the above-mentioned embodiment, the channel member 80 is fixed to the liquid injection head 70 by use of the screws 102, 103, and the head unit 60 is fixed to the carriage 46. By detaching the head unit 60 from the carriage 46, the channel member 80 may be detached from the liquid injection head 70 at a location distance from the carriage 46 with a sufficiently large working space.

B. Other Embodiments

B-1. Another Embodiment 1

In the above-mentioned embodiment, the liquid injection head 70 is fixed to the channel member 80 by use of the screws 102, 103. However, they are fixed to each other using any other fixing member. For example, a plate spring may be used as the fixing member, and the plate spring may fix the liquid injection head 70 to the channel member 80. The plate spring abuts the upper wall 71 and the channel bottom wall 105 and clamps the protrusion section 93 and the channel member 80. The use of the plate spring as the fixing member may further facilitate attachment and detachment between the liquid injection head 70 and the channel member 80.

B-2. Another Embodiment 2

In the above-mentioned embodiment, the channel member 80 is fixed to the liquid injection head 70 by use of the screws 102, 103. However, the liquid injection head 70 may be combined with another channel member having another channel structure in place of the channel member 80. Like the channel member 80, another channel member has the liquid emission port 85W and the air emission port 85V, and is detachable from the liquid injection head 70. In another channel member, the opening direction of the liquid emission port 85W and the air emission port 85V may be different from the opening direction of the liquid feeding port 81 and the air feeding port 83. For example, another channel member may be fixed to the carriage 46 by use of a screw or the like.

B-3. Another Embodiment 3

In the above-mentioned embodiment, the head unit 60 may be provided with anti-slip members for suppressing the screws 102, 104 from slipping off in the +Z direction when fastened to the respective nuts of the liquid injection head 70. A safety washer may be used as the anti-slip member. The anti-slip members are disposed on the −Z direction side of the screw insertion holes 802, 804 of the emission port layout wall 84 illustrated in FIG. 6. Alternatively, projections may be formed inside the screw insertion holes 802, 804 to constitute the safety washers.

B-4. Another Embodiment 4

In the above-mentioned embodiment, the channel member 80 includes the plurality of air emission ports 85*a*, 85*b* and the plurality of liquid emission ports 85*c*, 85*d*, 85*e*, and 85*f*. However, the number of the air emission ports and the liquid emission ports may be specifically limited.

B-5. Another Embodiment 5

In the above-mentioned embodiments, the liquid ejecting device is the printing device. However, the present disclosure may be applied to channel members for feeding liquid to liquid injection heads of liquid ejecting devices that inject other types of liquid. For example, the present disclosure is applicable to a liquid ejecting device that disperses or melts materials such as electrode materials used in manufacturing of liquid displays, and a channel member that feeds liquid to a liquid ejecting device for injecting biological organic materials used in manufacturing of biochips.

C. Other Embodiments

The present disclosure is not limited to the above-mentioned embodiments and may be realized in various embodiments so as not to deviate from the subject matter. For example, the present disclosure may be realized in following embodiments. To solve some or all of the problems of the present disclosure or achieve some or all of effects of the present disclosure, the technical features in the above-mentioned embodiments, which correspond to technical features in below-mentioned embodiments, may be appropriately replaced or combined. Unless the technical features are described herein to be essential, the technical features may be appropriately omitted.

(1) According to one embodiment of the present disclosure, the channel member that feeds liquid to the liquid injection head having the liquid introduction section oriented in the +Z direction that is the gravity direction is provided. The channel member includes the liquid emission port coupled to the liquid introduction section to emit the liquid to the liquid introduction section, and the liquid feeding port that receives the liquid to feed the liquid to the liquid emission port. The liquid emission port and the liquid feeding port have the same opening direction. In this embodiment, for example, by disposing the channel member such that the opening direction of the liquid feeding port and the liquid emission port becomes the −Z direction opposite to the +Z direction, the liquid may be received from the −Z direction side via the liquid feeding port to emit the liquid from the liquid emission port to the liquid introduction section. Thus, for example, when a member for passing liquid is coupled to the liquid feeding port, the efficiency of the coupling operation may be suppressed from lowering.

(2) In the above-mentioned embodiment, the liquid feeding port may be located on the −Z direction side opposite to the +Z direction side relative to the liquid emission port. In this embodiment, since the liquid feeding port is located on the −Z direction side relative to the liquid emission port, a space on the −Z direction side of the liquid feeding port is easily ensured. Thus, when a member for passing liquid is coupled to the liquid feeding port, the efficiency of the coupling operation may be suppressed from lowering.

(3) In the above-mentioned embodiment, a plurality of liquid feeding ports may be provided, and a plurality of liquid emission ports may be provided. Given that the direction orthogonal to the +Z direction is the Y direction, and the direction orthogonal to the +Z direction and the Y direction is an X direction, the plurality of liquid emission ports may be aligned in the Y direction, and a range in which the plurality of liquid feeding ports are located may be larger than a range in which the plurality of liquid emission ports are located in the X direction. In this embodiment, a large distance between the liquid feeding ports in the X direction may be ensured. Thus, the efficiency of the operation of coupling a member for passing liquid to each of the plurality of liquid feeding ports liquid may be suppressed from lowering.

(4) In the above-mentioned embodiment, a liquid channel that couples the liquid feeding port to the liquid emission port may be provided. Given that the direction orthogonal to the +Z direction is a Y direction and the direction orthogonal to the +Z direction and the Y direction is an X direction, the liquid channel may include a Y-direction channel extending in the Y direction and a Z-direction channel extending in a Z direction parallel to the +Z direction. In this embodiment, the channel member may be suppressed from becoming large in the X direction.

(5) In the above-mentioned embodiment, the channel member may further provided with a liquid emission channel that has the liquid emission port at one end and extends in the +Z direction, and a valve mechanism that is disposed in the liquid emission channel and opens when coupled to the liquid introduction section and closes when the liquid introduction section is detached from the liquid emission port. In this embodiment, the liquid may be suppressed from leaking to the outside through the liquid emission port.

(6) In the above-mentioned embodiment, an emission port layout wall having the liquid emission port may be provided. A screw insertion hole into which a screw for fixing the channel member to the liquid injection head may be formed on the emission port layout wall. In this embodiment, the liquid injection head may be fixed to the channel member by inserting the screw into the screw insertion hole. Also, in this embodiment, since the screw insertion hole is formed on the emission port layout wall provided with the liquid emission port, an increase in size of the channel member may be suppressed.

(7) In the above-mentioned embodiment, the plurality of liquid emission ports may be aligned in the Y direction. The screw insertion hole may be located between a first liquid emission port and a second liquid emission port among the plurality of liquid emission port. In this embodiment, in the case where the liquid injection head is fixed to the channel member by use of the screw, the possibility that coupling between the liquid emission ports and the respective liquid introduction sections are released may be lowered.

(8) In accordance with another embodiment of the present disclosure, a head unit is provided. The head unit may include a channel member in the above-mentioned embodiment, and a liquid injection head having a liquid introduction section oriented in a +Z direction that is a gravity direction, and the liquid feeding port may be located on a −Z direction side opposite to the +Z direction relative to the liquid injection head. In this embodiment, since the liquid feeding port is located on the −Z direction side relative to the liquid injection head, a space on the −Z direction side is easily ensured. Thus, in the case where a member for passing liquid is coupled to the liquid feeding port, the possibility that the liquid injection head becomes an obstacle may be decreased to suppress the efficiency of the coupling operation from lowering.

(9) In the above-mentioned embodiment, the liquid injection head may further include an introduction section layout wall that is provided with the liquid introduction section and is oriented in the +Z direction, and an upper wall that is a wall on the −Z direction side opposite to the +Z direction. The channel member may further include an emission port layout wall that is provided with the liquid emission port and is opposed to the introduction section layout wall, and an opposing wall opposed to the upper wall. In this embodiment, to attach/detach the channel member to/from the liquid injection head, when the channel member is moved in the +Z direction, the moving range of the channel member may be limited.

(10) In the above-mentioned embodiment, a carriage that fixes the liquid injection head is further provided. The carriage has a carriage bottom wall having an opening that exposed a nozzle. When viewed from the +Z direction side, a portion of the channel member and the carriage bottom wall may overlap each other. In this embodiment, the opening may be made smaller to decrease the possibility that the strength of the carriage lowers.

(11) According to another embodiment of the present disclosure, a head unit group is provided. The head unit group includes the plurality of head units in the above-mentioned embodiment. Given that the direction orthogonal to the +Z direction is a Y direction and the direction orthogonal to the +Z direction and the Y direction is an X direction, the plurality of head units is aligned in the Y direction. The plurality of the liquid injection heads of the plurality of head units each have a side wall having a convex section and a concave section. Given that one of the plurality of head units is a first head unit, the head unit adjacent to the first head unit and the Y direction is a second head unit, the liquid injection head of the first head unit is a first liquid injection head, the liquid injection head of the second head unit is a second liquid injection head, and the channel member of the first head unit is a first channel member, the convex section of the first liquid injection head is located in the concave section of the second liquid injection head, and a channel of the first channel member passes the liquid in the +Z direction, and the channel is located in the concave section of the second liquid injection head such that the channel is sandwiched between the first liquid injection head and the second liquid injection head in the Y direction. In this embodiment, since the concave section of the second liquid injection head may be effectively used to dispose the liquid channel, as compared to the case where the liquid channel is displaced from the first liquid injection head and the second liquid injection head in the X direction, an increase in size of the head unit group in the X direction may be suppressed.

(12) In the above-mentioned embodiment, when viewed from the −Z direction side opposite to the +Z direction, the channel member of the first head unit and the second head unit may be provided so as not to overlap each other. In this embodiment, when the first head unit is moved in the +Z direction, the first head unit may be suppressed from interfering with the second head unit. Thus, for example, when the first head unit is detached from the carriage or is attached to the carriage, the first head unit may be suppressed from interfering with the second head unit.

The present disclosure may be realized in various embodiments other than the channel member, the head unit, and the head unit group. For example, the present disclosure may be realized as a manufacturing method of the channel member, the head unit, or the head unit, or a liquid ejecting device provided with the head unit or the head unit group.

What is claimed is:

1. A channel member that is configured to feed liquid to a liquid injection head, the liquid injection head having a liquid introduction section which forms an introduction opening oriented in a +Z direction that is a downward direction when the channel member is connected to the liquid injection head, the channel member comprising:

a liquid emission port which forms an emission opening; and a liquid feeding port which forms a feeding opening that receives the liquid to feed the liquid to the liquid emission port, wherein the emission opening of the liquid emission port is coupled with the introduction opening of the liquid introduction section to emit the liquid to the liquid introduction section when the channel member is connected to the liquid injection head, and the emission opening of the liquid emission port and the feeding opening of the liquid feeding port are oriented in a −Z direction that is an upward direction when the channel member is connected to the liquid injection head.

2. The channel member according to claim 1, wherein the liquid feeding port is located on a −Z direction side opposite to a +Z direction side relative to the liquid emission port.

3. The channel member according to claim 1, wherein a plurality of the liquid feeding ports is provided, a plurality of the liquid emission ports is provided, given that a direction orthogonal to the +Z direction is a Y direction, and a direction orthogonal to the +Z direction and the Y direction is an X direction, the plurality of liquid emission ports is aligned in the Y direction, a range in the X direction in which the plurality of the liquid feeding ports is located is larger than a range in the X direction in which the plurality of the liquid emission ports is located.

4. The channel member according to claim 1, further comprising a liquid channel that couples the liquid feeding port to the liquid emission port, wherein given that a direction orthogonal to the +Z direction is a Y direction, and a direction orthogonal to the +Z direction and the Y direction is an X direction, the liquid channel includes a Y-direction channel extending in the Y direction and a Z-direction channel extending in a Z direction parallel to the +Z direction.

5. The channel member according to claim 1, further comprising:

a liquid emission channel having the liquid emission port at one end, the liquid emission channel extending in the +Z direction; and a valve mechanism disposed in the liquid emission channel, the valve mechanism opening when coupled to the liquid introduction section and closing when the liquid introduction section is detached from the liquid emission port.

6. The channel member according to claim 1, further comprising an emission port layout wall having the liquid emission port, wherein a screw insertion hole into which a screw is inserted is formed on the emission port layout wall, the screw serving to fix the channel member to the liquid injection head.

7. The channel member according to claim 6, wherein given that a direction orthogonal to the +Z direction is a Y direction, a plurality of the liquid emission ports is aligned in the Y direction, and the screw insertion hole is located between a first liquid emission port and a second liquid emission port among the plurality of the liquid emission ports.

8. A head unit comprising:

the channel member according to claim 1; and the liquid injection head having the liquid introduction section having an opening direction in a +Z direction that is a downward direction, wherein the liquid feeding port is located on a −Z direction side opposite to the +Z direction side relative to the liquid injection head.

9. A head unit comprising:

the channel member according to claim 6; and the liquid injection head having liquid introduction section having an opening direction in a +Z direction that is a downward direction, wherein the liquid feeding port is located on a −Z direction side opposite to the +Z direction side relative to the liquid injection head.

10. The head unit according to claim 8, wherein the liquid injection head further includes:

an introduction section layout wall on which the liquid introduction section is disposed, the introduction section layout wall being oriented in the +Z direction; and an upper wall that is a wall on the −Z direction side opposite to the +Z direction side, and the channel member further includes:

an emission port layout wall on which the liquid emission port is disposed, the emission port layout wall being opposed to the introduction section layout wall; and an opposing wall opposed to the upper wall.

11. The head unit according to claim 8, further comprising a carriage that fixes the liquid injection head, wherein the carriage has a carriage bottom wall having an opening that exposes a nozzle, and when viewed from the +Z direction side, a portion of the channel member and the carriage bottom wall overlap each other.

12. A head unit group comprising a plurality of head units according to claim 8, wherein given that a direction orthogonal to the +Z direction is a Y direction, and a direction orthogonal to the +Z direction and the Y direction is an X direction, the plurality of head units is aligned in the Y direction, the plurality of the liquid injection heads of the plurality of head units each have a side wall having a convex section and a concave section, given that one of the plurality of head units is a first head unit, the head unit adjacent to the first head unit in the Y direction is a second head unit, the liquid injection head of the first head unit is a first liquid injection head, the liquid injection head of the second head unit is a second liquid injection head, and the channel member of the first head unit is a first channel member, the convex section of the first liquid injection head is located in the concave section of the second liquid injection head, and a channel of the first channel member passes the liquid in the +Z direction, and the channel is located in the concave section of the second liquid injection head such that the channel is sandwiched between the first liquid injection head and the second liquid injection head in the Y direction.

13. The head unit group according to claim 12, wherein when viewed from a −Z direction side opposite to the +Z direction side, the channel member of the first head unit and the second head unit do not overlap each other.

14. The channel member according to claim 1, wherein the liquid injection head and the liquid feeding port are located in this order in the −Z direction when the channel member is connected to the liquid injection head.

* * * * *